US009542821B2

(12) United States Patent
Watanabe et al.

(10) Patent No.: US 9,542,821 B2
(45) Date of Patent: Jan. 10, 2017

(54) HOME SECURITY SYSTEM AND VEHICLE-MOUNTED SYSTEM USED BY SAME

(75) Inventors: Yoshiaki Watanabe, Tokyo (JP); Masahiro Abukawa, Tokyo (JP); Takeshi Mitsui, Tokyo (JP); Takehisa Mizuguchi, Tokyo (JP); Yoshihiro Nakai, Kobe (JP); Tsutomu Matsubara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 195 days.

(21) Appl. No.: 14/353,683

(22) PCT Filed: Jan. 10, 2012

(86) PCT No.: PCT/JP2012/000087

§ 371 (c)(1),
(2), (4) Date: Apr. 23, 2014

(87) PCT Pub. No.: WO2013/105125

PCT Pub. Date: Jul. 18, 2013

(65) Prior Publication Data

US 2014/0300492 A1 Oct. 9, 2014

(51) Int. Cl.

| | |
|---|---|
| ***G08G 1/00*** | (2006.01) |
| ***G08B 13/00*** | (2006.01) |
| ***G08G 1/0962*** | (2006.01) |
| ***G08B 7/06*** | (2006.01) |
| ***G08B 25/14*** | (2006.01) |
| *G08B 15/00* | (2006.01) |
| *G08B 25/00* | (2006.01) |

(52) U.S. Cl.

CPC ..... *G08B 13/00* (2013.01); *G08B 7/064* (2013.01); *G08B 25/14* (2013.01); *G08G 1/0962* (2013.01); *G08B 15/00* (2013.01); *G08B 25/009* (2013.01)

(58) Field of Classification Search

CPC ..... B60R 2325/304; B60R 25/1004; B60R 25/102; G08B 13/1427; G08B 25/008; G08B 25/14; G08B 21/0225

(Continued)

(56) References Cited

U.S. PATENT DOCUMENTS 6,591,094 B1 * 7/2003 Bentley ..... B60R 25/1004 455/405
8,665,084 B2 * 3/2014 Shapiro ..... G08B 3/10 340/506

(Continued)

FOREIGN PATENT DOCUMENTS

CN 201607810 U 10/2010
JP 2003-208680 A 7/2003

(Continued)

OTHER PUBLICATIONS

International Search Report issued in PCT/JP2012/000087, dated Apr. 17, 2012.

*Primary Examiner* — Eric M Blount
(74) *Attorney, Agent, or Firm* — Birch, Stewart, Kolasch & Birch, LLP

(57) ABSTRACT

A home security system includes an in-home system and a vehicle-mounted system, wherein the in-home system includes an in-home sensor that is mounted in a home and is capable of detect a state of the home, and an in-home communication module that is capable of communicating with the vehicle-mounted system to sense an abnormality from information of the in-home sensor, and wherein the vehicle-mounted system includes a vehicle-mounted device that is mounted on a vehicle that is capable of a vehicle outside output, and a vehicle-mounted communication module that is capable of communicating with the in-home system via the in-home communication module, and when the in-home system senses the abnormality, an instruction is (Continued)

received from the in-home system via the in-home communication module and vehicle-mounted communication module to deal with the abnormality using the vehicle-mounted device according to the instruction.

18 Claims, 19 Drawing Sheets

(58) Field of Classification Search
USPC ..... 340/901
See application file for complete search history.

(56) References Cited

U.S. PATENT DOCUMENTS 8,786,434 B2 * 7/2014 Sennett ..... G08B 13/19682 340/5.1
2005/0062602 A1 3/2005 Fujiwara et al.
2005/0128068 A1 * 6/2005 Winick ..... B60R 25/1004 340/517
2006/0017565 A1 * 1/2006 Addy ..... G08B 13/1966 340/539.14
2007/0279209 A1 * 12/2007 Kogan ..... B60R 25/1004 340/506
2010/0141201 A1 * 6/2010 Littrell ..... H02J 7/35 320/101
2012/0169487 A1 * 7/2012 Poder ..... B60R 25/102 340/426.15

FOREIGN PATENT DOCUMENTS

JP 2007-72686 A 3/2007
JP 2010-92221 A 4/2010
JP 2010-140451 A 6/2010
JP 2011-232877 A 11/2011

* cited by examiner

HOME SECURITY SYSTEM AND VEHICLE-MOUNTED SYSTEM USED BY SAME

TECHNICAL FIELD

The present invention relates to a home security system using a vehicle-mounted system equipped with a variety of sensors.

BACKGROUND ART

In recent automobiles, various sensors are attached thereto for a variety of safety and security functions. Under present circumstances, they are used only during traveling and not used during parking. However, it must be possible to enhance safety and security of the surroundings by using the vehicle-mounted sensor in parking. Thus, it has been considered to enhance a home security by utilizing sensor information of the automobile parked at one's own home.

For example, in Patent Document 1, there is disclosed a security system that is operated by connecting a home to a vehicle and makes an alarm for a suspicious person existing around the connected vehicle. Further, for example, in Patent Document 2, there is disclosed a security system that monitors one's own home or the inside of its site by sharing between a vehicle and a home information of various sensors such as a camera attached to the vehicle with a power line to thereby notify a user at home or a security company of an abnormality. Furthermore, for example, in Patent Document 3, there is disclosed a monitoring device as follows: when an automobile is being charged with physically connected to a power supply plug of one's own home, an abnormality sensing is performed on the basis of information of various sensors such as a camera attached to the automobile, and when an abnormality is sensed, a registered contact destination is notified of the effect that the abnormality is sensed.

PRIOR ART DOCUMENTS

Patent Documents

Patent Document 1: Japanese Patent Application Laid-open No. 2010-92221

Patent Document 2: Japanese Patent Application Laid-open No. 2007-72686

Patent Document 3: Japanese Patent Application Laid-open No. 2010-140451

SUMMARY IN THE INVENTION

Problems to be Solved by the Invention

However, in the conventional technologies as disclosed in Patent Document 1 to 3, for example, there is disclosed the system that is operated only in a state during charging such that the vehicle is connected to the home by a physical cable; there is a problem such that even if the vehicle is parked, the system do not operate when the home is not physically connected to the home. Further, in the conventional technology as disclosed in Patent Document 1, for example, there is also a problem such that a function of the security system is restricted to sensing of a suspicious person around the vehicle and to theft prevention for power and vehicle, and thus cannot deal with a case of an occurrence of abnormalities such as fire, blackout, and/or the like. Furthermore, even in the conventional technologies like Patent Documents 2 and 3, there is also a problem such that although it is possible to notify the user at home or the specified contact destination of an abnormality, when a fire, for example, occurs, it is not possible to promptly inform the neighborhood of such an abnormality.

The present invention has been made to solve the foregoing problems, and an object of the invention is to provide a home security system using a vehicle-mounted system that can be operated by communication even if the vehicle is not physically connected to the home, and that can notify the neighborhood of an abnormality using a vehicle-mounted system when an in-home system detects the abnormality.

Means for Solving the Problems

In order to achieve the above object, the present invention provides a home security system that includes an in-home system and a vehicle-mounted system, the in-home system including an in-home sensor that is installed in a home and is capable of detecting a state of the home, and an in-home communication module that is capable of communicating with the vehicle-mounted system to sense an abnormality from information of the in-home sensor, and the vehicle-mounted system including a vehicle-mounted device that is mounted on a vehicle and is capable of a vehicle outside output, and a vehicle-mounted communication module that is capable of communicating with the in-home system via the in-home communication module, and when the in-home system senses the abnormality, an instruction is received from the in-home system via the in-home communication module and vehicle-mounted communication module to deal with the abnormality using the vehicle-mounted device according to the instruction, the vehicle-mounted system further comprising a vehicle-mounted sensor that is mounted on the vehicle and is capable of detecting a state around or inside the vehicle, and when the abnormality is sensed, the in-home system permiys the information of the in-home sensor and the vehicle-mounted sensor to be browsed from an external terminal.

EFFECT OF THE INVENTION

The home security system of the invention can be operated by communication even if the vehicle is not physically connected to the home, and can notify the neighborhood of an abnormality using the vehicle-mounted system when the in-home system detects the abnormality.

BEST MODE FOR CARRYING OUT THE INVENTION

Hereinafter, embodiments of the present invention will be described in detail with reference to the accompanying drawings.

Embodiment 1

Figure 1:
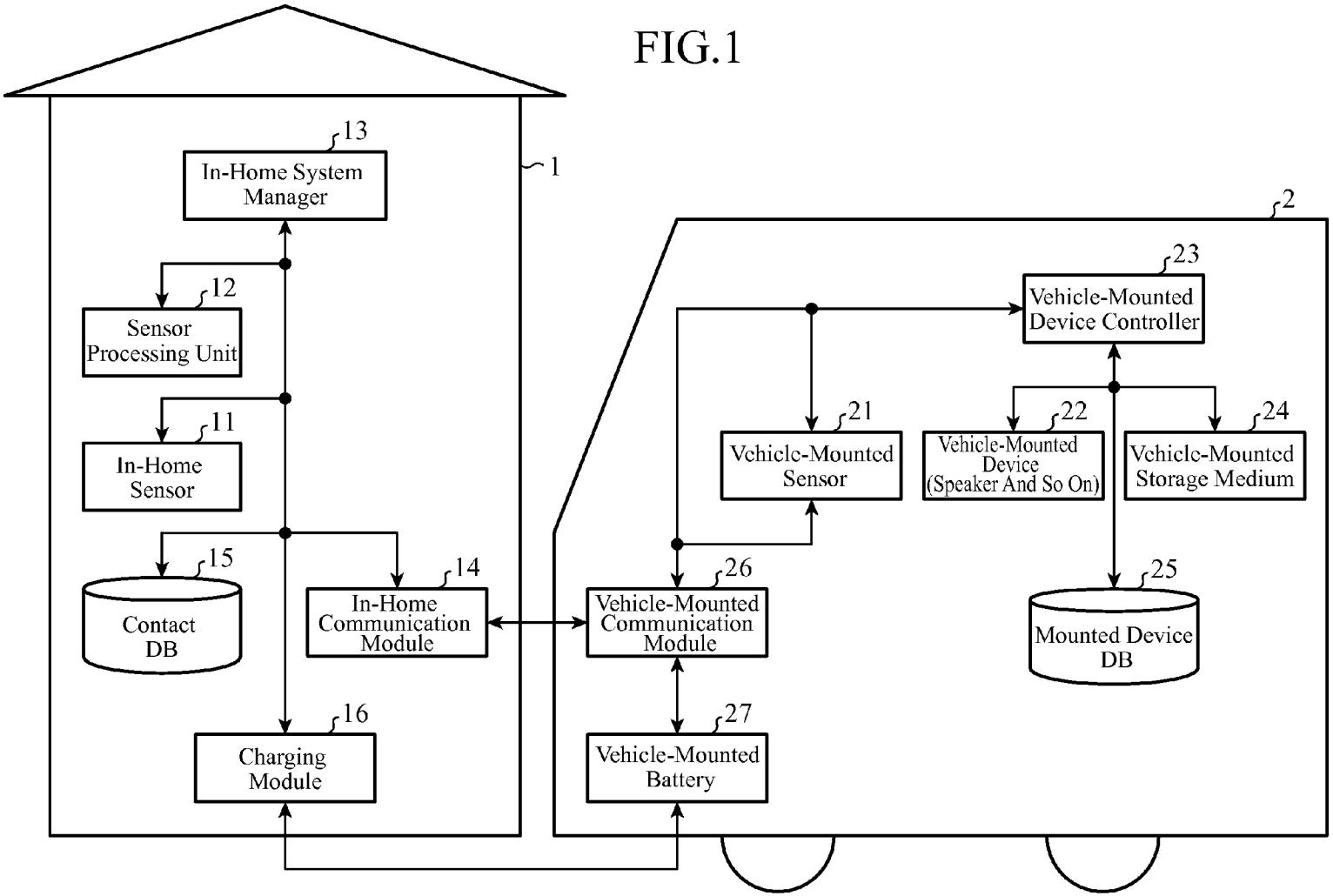
FIG. 1 is a block diagram showing a configuration of a home security system according to Embodiment 1.

FIG. 1 is a block diagram showing a configuration of a home security system according to Embodiment 1 of the invention. The home security system is configured with an in-home system 1 and a vehicle-mounted system 2, and it is a home security system using the vehicle-mounted system 2.

The in-home system 1 is a system in a home introducing a security system, and has an in-home sensor 11, a sensor processing unit 12, an in-home system manager 13, an in-home communication module 14, a contact database (contact DB) 15, and a charging module 16.

In addition, the vehicle-mounted system 2 has a vehicle-mounted sensor 21, a vehicle-mounted device 22, a vehicle-mounted device controller 23, a vehicle-mounted storage medium 24, a mounted device database (mounted device DB) 25, a vehicle-mounted communication module 26, and a vehicle-mounted battery 27.

The in-home sensor 11 includes various sensors such as a camera, a temperature sensor and the like that are installed in the home and are capable of detecting a state of the home; the vehicle-mounted sensor 21 includes various sensors such as a camera, an ultrasonic sensor and the like that are mounted on a vehicle and are capable of detecting a state around or inside of the vehicle. Further, the vehicle-mounted device 22 includes devices such as a speaker, a light, and/or the like that are mounted on the vehicle and are capable of a vehicle outside output.

The sensor processing unit 12 processes collectively information (data) from the in-home sensor 11 and the vehicle-mounted sensor 12 to determine presence or absence of an abnormality from these pieces of sensor information.

Also, the contact database 15 is the database that when the sensor processing unit 12 senses an abnormality, transmission destinations (contact destinations in abnormality) such as a home owner, a security company, a fire station, and a police station are registered in advance and informed of the abnormality.

The in-home system manager 13 is the system manager (controller) that manages the security system in the home, and when communication is established between the in-home system 1 and the vehicle-mounted system 2, the manager manages an integrated system combining the two systems. In the integrated system, data is acquired from each module, or an instruction is given to each module. For example, in a case where an abnormality is sensed as a result of sending the sensor information by the in-home sensor 11 and the vehicle-mounted sensor 21 to the sensor processing unit 12, an instruction is transmitted to output a message from a speaker (vehicle-mounted device) 22 to the vehicle-mounted device controller 23 in the vehicle-mounted system 2.

The vehicle-mounted storage medium 24 is the storage medium mounted on the vehicle, and serves to record various pieces of sensor information by the in-home sensor 11 and the vehicle-mounted sensor 21. However, since the storage medium is not necessarily a dedicated medium for recording the sensor information, it may be, for example, a storage area in a car navigation system.

In addition, the mounted device database 25 serves to store in advance information of a list of the devices mounted on the vehicle. The system refers to this database when confirming available vehicle-mounted devices.

Then, the vehicle-mounted device controller 23 performs operating the vehicle-mounted device 22 of each type, writing and reading data to and from the vehicle-mounted storage medium 24, acquiring the list of the vehicle-mounted devices using the mounted device database 25, and/or the like.

The in-home communication module 14 is the communication module for performing giving and receiving data and instructions between the home (in-home system 1) and the vehicle (vehicle-mounted system 2). As a communication method, a wireless communication, a power line communication, and the like are considered. Additionally, the in-home communication module may make communication with an external terminal. However, considering a possibility that when an abnormality occurs, the in-home communication module 14 is inoperable for the following reason, for example: the in-home communication module 14 is broken by a suspicious person, burnt down by fire, or the like, it is assumed that communication with the external is performed mainly using the vehicle-mounted communication module 26 when the home security system using the vehicle-mounted system 2 is operated.

The vehicle-mounted communication module 26 makes communication with the in-home communication module 14, and gives notification to external terminals of registrants (a home owner, a family, a relative, and so on) and/or registered facilities (a security company, a fire station, a police station, and so on) that are registered in advance when an abnormality is sensed. Since the vehicle-mounted communication module 26 is equipped inside the vehicle, it is operable without being affected by an abnormality in the home, and thus the vehicle-mounted communication module 26 is mainly used as a communication means with the external terminal. However, this never restricts communication with the external terminal made by the in-home communication module 14, and thus the in-home communication module 14 may be used as a sub module when communicating with the external terminal. The communication with the external terminal is performed by the wireless communication. As a communication method with the in-home communication module 14, either one of the wireless communication and wire communication using the power line or the like may be used.

Note that the vehicle-mounted battery 27 is the battery mounted on the vehicle. Further, the charging module 16 is the module for charging the vehicle-mounted battery 27.

Figure 2:
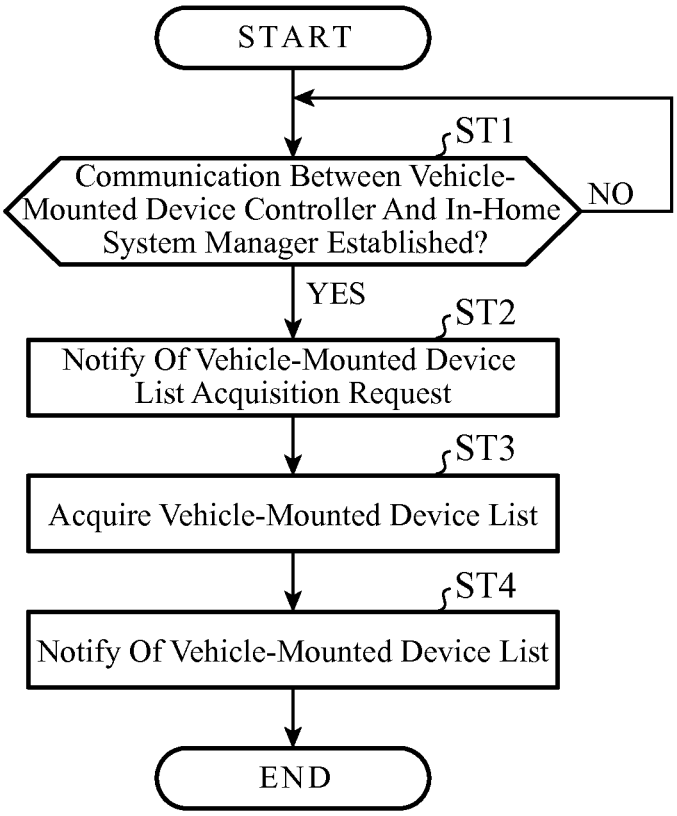
FIG. 2 is a flowchart showing processing from activation of the home security system to acquisition of a list of vehicle-mounted devices according to Embodiment 1.

Next, processing of the system will be described. FIG. 2 is a flowchart showing processing from activation of the home security system to acquisition of the list of the vehicle-mounted devices according to Embodiment 1.

Before communication is established between the vehicle-mounted device controller 23 and the in-home system manager 13 (case of "NO" at Step ST1), the in-home system 1 merely operates a normal security system, and the home security system using the vehicle-mounted system 2 is not activated. On this occasion, either one of the wireless communication and wire communication may be employed as a communication method between the vehicle-mounted device controller 23 and the in-home system manager 13. Then, in the case of the wireless communication, the communication is established when a user presses a button for a communication establishment request or the like from the external device that communicates with the vehicle side or vehicle-mounted communication module. Meanwhile, in the case of the wire communication, the communication is established when a cable for charging is physically connected thereto.

Then, when the communication is established between the vehicle-mounted device controller 23 and the in-home system manager 13 (case of "YES" at Step ST1), the in-home system manager 13 notifies the vehicle-mounted device controller 23 of an acquisition request of the list of the vehicle-mounted devices that are mounted on the vehicle (Step ST2), in order to search which kind of vehicle-mounted device is available for a abnormality countermeasure. Then, upon receiving the request from the in-home system manager 13, the vehicle-mounted device controller 23 acquires the list of the vehicle-mounted devices mounted on the vehicle from the mounted device database 25 (Step ST3). Then, the vehicle-mounted device controller 23 that acquires the list of the vehicle-mounted devices mounted on the vehicle notifies the in-home system manager 13 of that list (Step ST4). Then, when an abnormality occurs, based on the list of the vehicle-mounted devices notified at Step ST4, the in-home system manager 13 issues an instruction to the vehicle-mounted device controller 23 in order to deal with the abnormality by operating an available vehicle-mounted device. Then, the vehicle-mounted device controller 23 having received the instruction from the in-home system manager 13 deals with the abnormality according to the instruction. Note that the processing at the occurrence of the abnormality will be described later.

Figure 3:
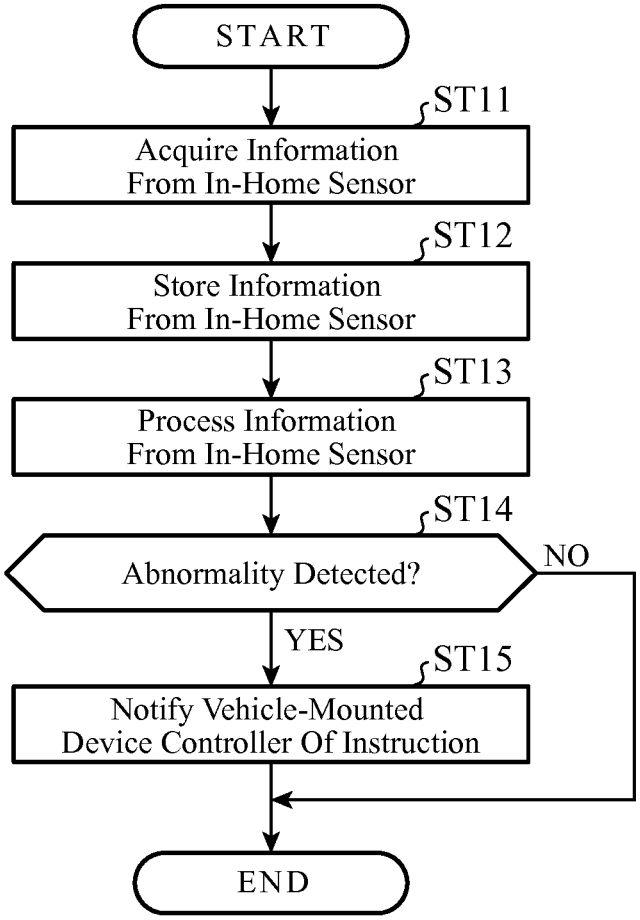
FIG. 3 is a flowchart showing basic processing of the home security system according to Embodiment 1.

FIG. 3 is a flowchart showing basic processing in which the home security system according to Embodiment 1 performs at constant time intervals after activation of the system.

The in-home system manager 13 acquires sensor information at every constant time from the in-home sensor 11 (Step ST11), and stores the acquired information from the in-home sensor in the vehicle-mounted storage medium 24 (Step ST12). This is because although the sensor information acquired from the in-home sensor 11 is stored in the sensor processing unit 12 in the home, there is a possibility that the sensor information is damaged by an intruder or a disaster such as a fire if it is stored only in the home. Thus, when the memory to the vehicle-mounted storage medium 24 is made possible, data can be memorized without omission even at that time of such damage. Further, when the data is stored regardless of presence/absence of the occurrence of an abnormality, even if the abnormality is overlooked, it is possible to confirm afterward the situation at that time.

Thereafter, the in-home system manager 13 notifies the sensor processing unit 12 of the acquired sensor information, and causes it to confirm presence/absence of an abnormality (Step ST13). Then, when the sensor processing unit 12 confirms and determines presence of an abnormality, the in-home system manager 13 is notified of the processing result, so that the in-home system manager 13 senses the abnormality. Specifically, the sensor processing unit 12 senses the abnormality; as a result, when the in-home system manager 13 recognizes the occurrence of the abnormality (case of "YES" at Step ST14), the in-home system manager 13 notifies the vehicle-mounted device controller 23 of an abnormality countermeasure instruction using available vehicle-mounted devices, on the basis of the list of the vehicle-mounted devices notified and acquired at Step ST4 in FIG. 2 (Step ST15).

Figure 4:
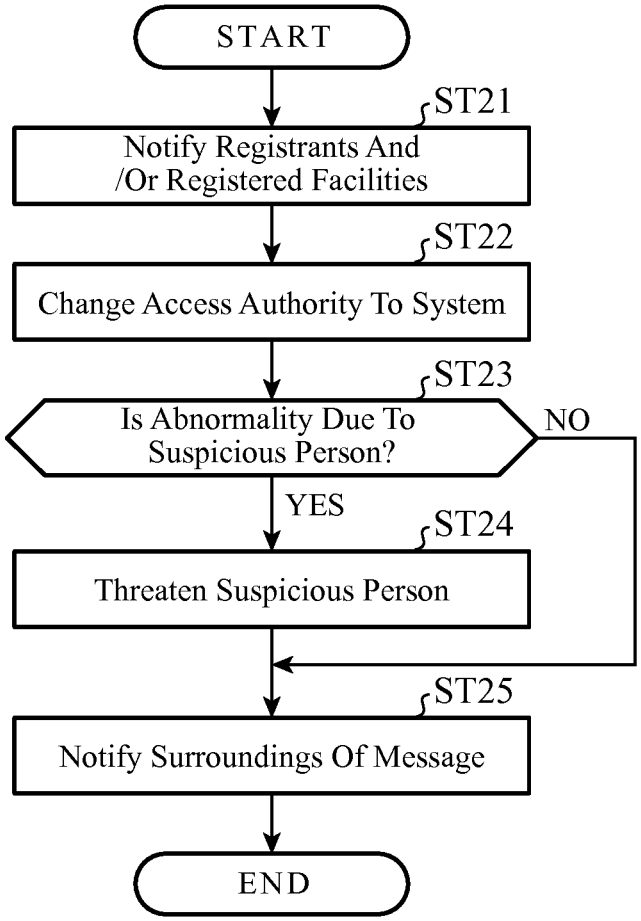
FIG. 4 is a flowchart showing abnormality countermeasure processing of the home security system according to Embodiment 1.

FIG. 4 is a flowchart showing abnormality countermeasure processing performed by the home security system according to Embodiment 1 when an abnormality is sensed.

When an abnormality is sensed in the determination at Step ST14 shown in FIG. 3 (case of "YES" at Step ST14), the vehicle-mounted device controller 23 is notified of an abnormality countermeasure instruction; as a result, notification is performed from the vehicle-mounted communication module 26 to the registrants and the registered facilities (Step ST21). When a certain abnormality occurs in the home, the user wants to know what kind of abnormality occurs as soon as possible; thus, at the occurrence of an abnormality, the registrant is notified of the effect of the occurrence of the abnormality and what kind of abnormality has occurred. Meanwhile, in a case of a disaster such as a fire, and a case of an intruder of a suspicious person, it is often hard to deal with these cases by individuals. For that reason, when notification is also given to facilities such as a fire station and a police station that are adequate to deal with the sensed abnormality, it becomes possible to deal with the abnormal condition. Note that the description is given in this case assuming that the notification is given from the vehicle-mounted communication module 26; however, the notification may be given using the in-home communication module 14 if the in-home communication module 14 can communicate with the external.

On this occasion, it is unable to understand the present situation by only the notification of the effect of the occurrence of the abnormality and what kind of abnormality has occurred; however, it becomes possible to promptly deal with the abnormality by having understood the present situation of a site before arriving at the site. For that reason, the following is desirable: it is adapted such that an image from the camera that is one of the in-home sensors 11 can be browsed from the external in real time, in other words, sensor information in the in-home system 1 is browsable from the external. However, since a fact that everyone can browse the information is problematic in view of privacy and so on; thus, when an abnormality is sensed, a change of an access authority to the system is carried out so that only the registrants and registered facilities registered in the contact database 15 are permitted to browse the information from the in-home sensor 11 and/or the vehicle-mounted sensor 21 from the external terminal (Step ST22).

Specifically, for example, the system gives the notification to the registrants and/or registered facilities at Step ST 21 by an e-mail, and a URL for accessing the system from the external terminal is described in the e-mail. At the same time, the change of the access authority to the system at Step ST22 is carried out. In this manner, the registrants and registered facilities receiving the notification of the abnormality can browse the sensor information in the in-home system 1 by accessing the URL described in the notified e-mail.

In this case, when the abnormality sensed at Step ST14 in FIG. 3 is due to intrusion of a suspicious person (case of "YES" at Step ST23), an output for threatening the suspicious person is carried out using the vehicle-mounted device 22 by shining it using a vehicle-mounted light, by sounding a buzzer, by imaging it by a vehicle-mounted camera, and/or the like (Step ST24). In such a way, there is an advantageous effect that it becomes possible to send the suspicious person away as soon as possible when the suspicious person intrudes into one's home site.

Then, in either of the case where the abnormality is due to the suspicious person and a case due to another abnormality, in order to inform the neighborhood of the effect that the abnormality is sensed, the surroundings are notified of a message from the vehicle-mounted device 22 such as a speaker that is capable of a vehicle outside output (Step ST25). This is because: after the notification to the registrants and/or registered facilities, it takes time for a user to rush to the site or for a member dispatched from the registered facility to arrive thereat; however, in the meantime, since a situation thereof changes from moment to moment, there are cases where some countermeasures are needed before the arrival of the member and where it is possible to take a countermeasure by an assistance of the neighbors. Thus, by asking the neighbors for help and informing them of what kind of abnormality has occurred, it is possible to shorten the time taken from the occurrence of the abnormality to an initial countermeasure therefor. For the message to be informed, notification is given with a change according to the sensed abnormality, for example, outputting a message "Fire!" in the case of sensing a fire, outputting a message "Suspicious person, Be careful!" in the case of sensing a suspicious person, and the like. Note that the message is changeable.

It is noted that in Embodiment 1, the description is given to the case where the home security system is to be activated when communication is established between the vehicle-mounted device controller 23 and the in-home system manager 13 (case of "YES" at Step ST1 in the flowchart shown in FIG. 2) however, as an example of another processing flow, it may be configured such that the home security system is activated if an abnormality is sensed.

Figure 5:
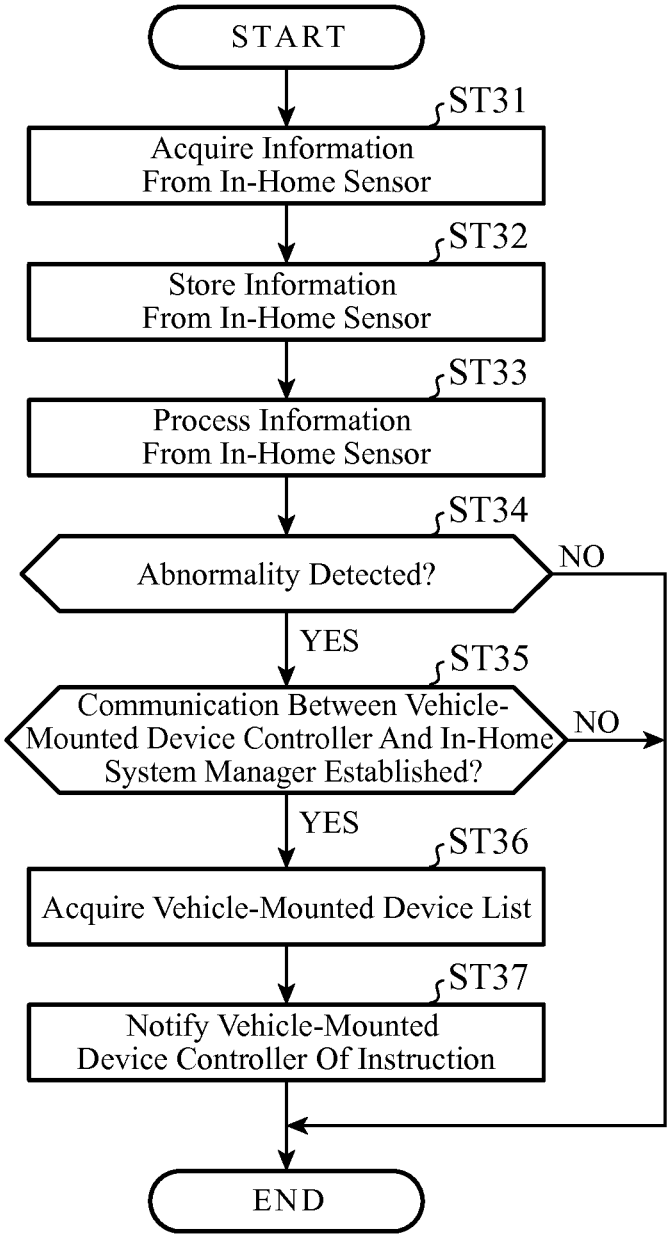
FIG. 5 is a flowchart showing another example from activation to basic processing of the home security system according to Embodiment 1.

FIG. 5 is a flowchart showing another example from the activation to the basic processing of the home security system according to Embodiment 1.

Processing from Step ST31 to Step ST33 are the same as those of Steps ST11 to ST13 shown in FIG. 3, and thus descriptions therefor will be omitted. When the in-home system manager 13 determines that an abnormality has occurred (case of "YES" at Step ST34), it further determines whether communication is established between the vehicle-mounted device controller 23 and the in-home system manager 13 (Step ST35). When this communication is established (case of "YES" at Step ST35), the in-home system manager 13 acquires a list of vehicle-mounted devices that are available for the abnormality countermeasure from the vehicle-mounted device controller 23 (Step ST36). Note that a process at Step ST36 is described collectively the processes of Steps ST2 to ST4 shown in FIG. 2.

Then, the in-home system manager 13 notifies the vehicle-mounted device controller 23 of an abnormality countermeasure instruction using the available vehicle-mounted device, on the basis of the acquired list of the vehicle-mounted devices (Step ST37). Note that processing at the time of abnormality sensing is the same as the flowchart shown in FIG. 4 and its description.

As described above, according to Embodiment 1, the system can operate by the communication even if the vehicle and the home are not physically connected to each other, and can notify the neighborhood of an abnormality using the vehicle-mounted device mounted on the vehicle when the in-home system detects the abnormality.

In addition, when the abnormality is due to a suspicious person, it is possible to threaten the suspicious person using the vehicle-mounted devices, or to record a feature or action of the suspicious person.

Further, by storing the information from the in-home sensor and the vehicle-mounted sensor in the vehicle-mounted storage medium, hypothetically, even in a case where a storage medium in the home is in trouble or capacity thereof is filled, it becomes possible to execute, for example, a cause can be analyzed from the information stored in the vehicle-mounted storage medium.

In addition, when an abnormality occurs, not only the registrants is informed that the abnormality has occurred, but also the facilities suitable for a countermeasure therefor, such as a fire station, a police station, and so on, are informed thereof, so that it becomes possible to promptly deal with the abnormality.

Moreover, when an abnormality occurs, the information from the in-home sensor and the vehicle-mounted sensor is made browsable from the external terminal, so that it is possible to help grasp what happens at that place.

Embodiment 2

Figure 6:
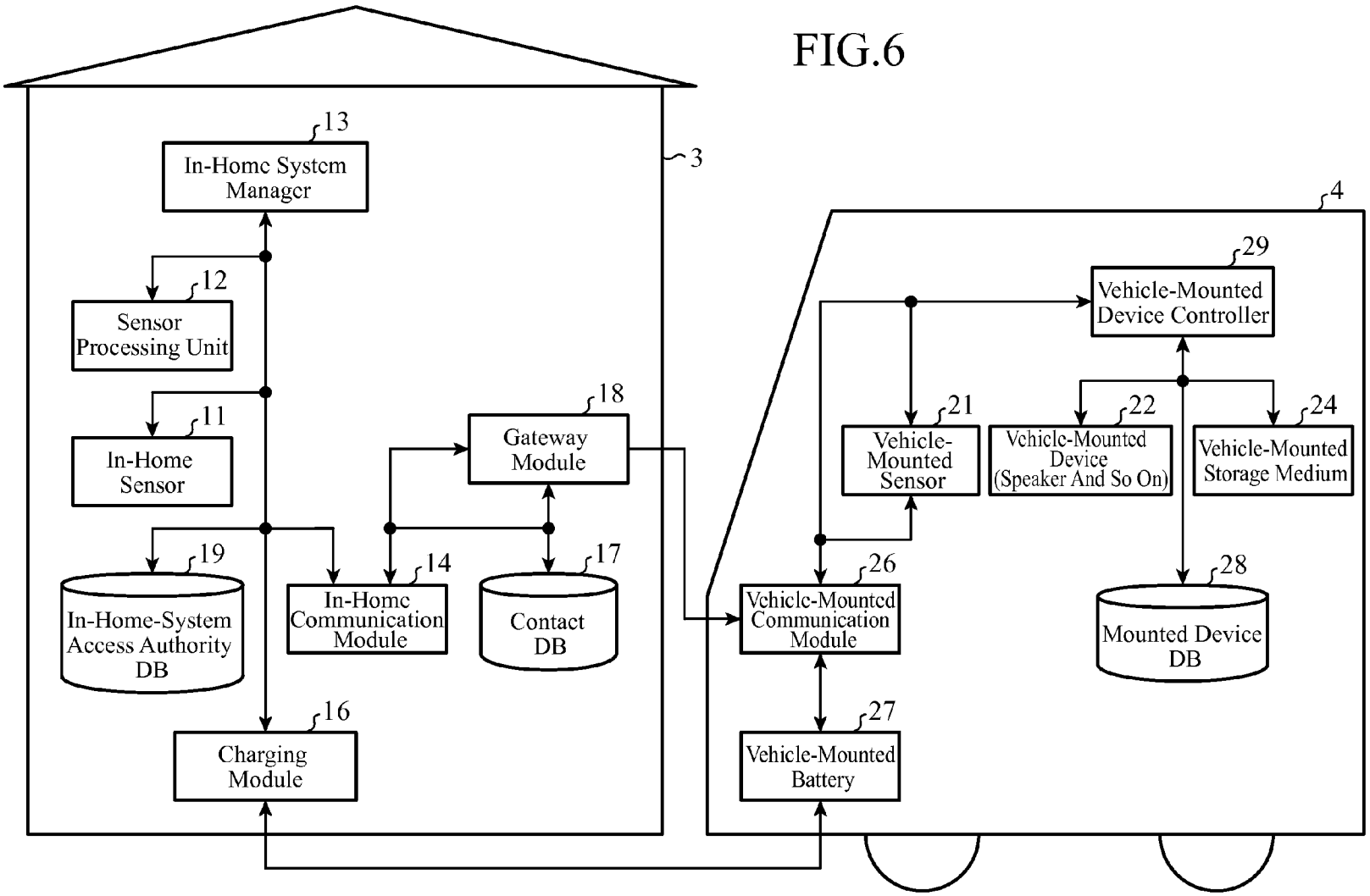
FIG. 6 is a block diagram showing a configuration of a home security system according to Embodiment 2.

FIG. 6 is a block diagram showing a configuration of a home security system according to Embodiment 2. The home security system is configured with an in-home system 3 and a vehicle-mounted system 4, and is a home security system using the vehicle-mounted system 4. Note that the same reference numerals are given for components similar to those described in Embodiment 1, and duplicated descriptions thereof will be omitted.

In comparison with the in-home system 1 shown in Embodiment 1, the in-home system 3 in Embodiment 2 shown below has a contact database (contact DB) 17 whose content is different from that of the contact database 15 in Embodiment 1, and further includes a gateway module 18 and an in-home-system access authority database (in-home-system access authority DB) 19. In addition, in comparison with the vehicle-mounted system 2 shown in Embodiment 1, the vehicle-mounted system 4 in Embodiment 2 has a mounted device database (mounted device DB) 28 whose content is different from that of the mounted device database 25 in Embodiment 1, and further has a vehicle-mounted device controller 29 whose function is different from that of the vehicle-mounted device controller 23 in Embodiment 1.

The contact database 17 is an access destination database that not only holds a list of contact destinations at the time of abnormality like the contact database 15, but also holds access authority information for each of registrants and registered facilities. The "access authority" referred to here represents whether an access to the inside of the system is permitted or not in each of a normal time and an abnormality sensing time.

Then, by referring to the access authority described in the contact database 17, the gateway module 18 determines whether or not the in-home system manager 13 should be notified of a request from an external terminal.

Meanwhile, the in-home-system access authority database 19 is the in-home-system operation authority database that holds operation propriety information for each in-home sensor 11 within the in-home system 3.

The mounted device database 28 is the mounted-device and vehicle-mounted-system operation authority database that not only holds a list of available vehicle-mounted devices mounted on the vehicle like the mounted device database 25, but also operation propriety information for each vehicle-mounted sensor 21 and each vehicle-mounted device 22.

Then, the vehicle-mounted device controller 29 has a function of determining operation proprieties of each vehicle-mounted sensor 21 and/or each vehicle-mounted device 22 on the basis of the information described in the mounted device database 28.

It is problematic in view of privacy if all registrants and all registered facilities are accessible to the in-home system 3 and the vehicle-mounted system 4 not only at the time of abnormality occurrence but also at the normal time. Thus, in Embodiment 2, the gateway module is provided for restricting an access to the system at the normal time other than at the time of abnormality occurrence, and in an access from the external terminal, privacy protection is achieved by the access via the gateway module.

Figure 7:
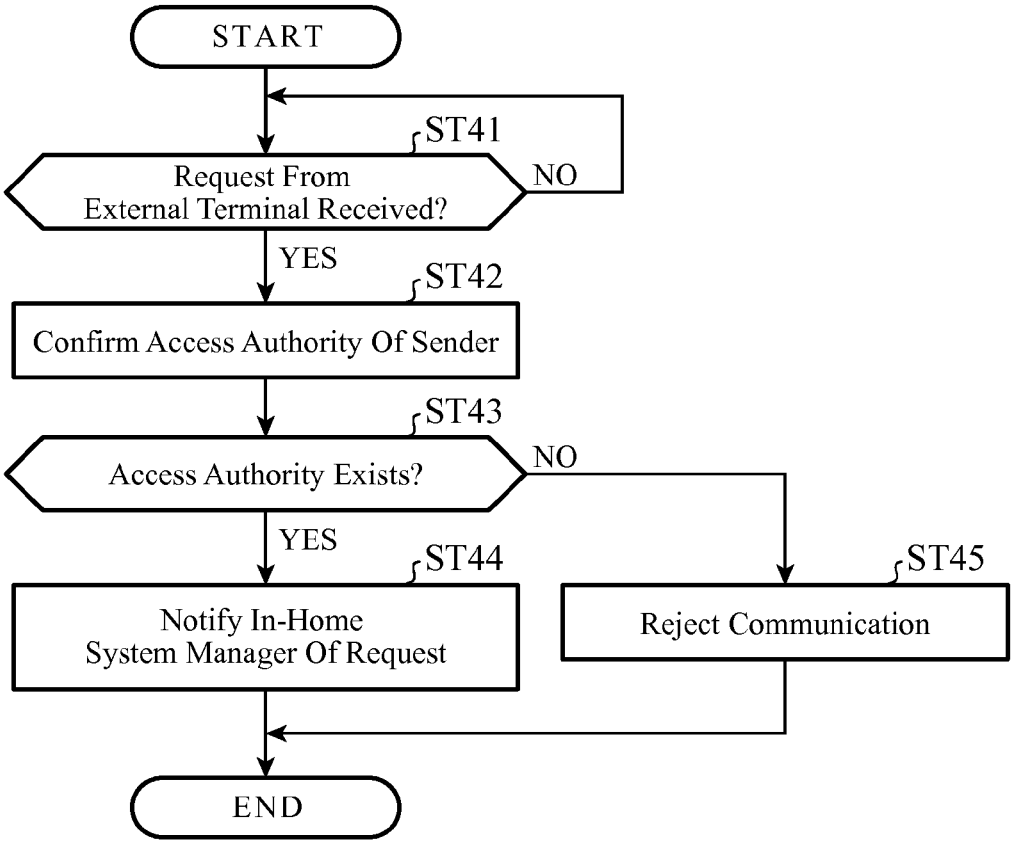
FIG. 7 is a flowchart showing access restriction processing at a normal time of the home security system according to Embodiment 2.

FIG. 7 is a flowchart showing access restriction processing at the normal time of the home security system according to Embodiment 2.

First, upon receiving a request from the external terminal through the vehicle-mounted communication module 26 (case of "YES" at Step ST41), the gateway module 18 confirms the access authority to the system at the normal time for a request transmitter by referring to the contact database 17 (Step ST42). If it is determined that the access authority exists (case of "YES" at Step ST43), the gateway module 18 notifies the in-home system manager 13 of the request (Step ST44). Then, the in-home system manager 13 operates each module according to the received request.

It is noted that as the request from the external terminal, there are considered not only a request to browse the information from the in-home sensor 11 and/or the vehicle-mounted sensor 21, but also a request that wishes to operate the in-home sensor 11, the vehicle-mounted sensor 21, and/or the vehicle-mounted device 22 when an abnormality is sensed for confirmation of the situation, a countermeasure therefor, and/or the like. Even in this case, since the security is enhanced by way of the gateway module 18, the external terminals of the registrants and registered facilities registered in advance in the contact database 17 may be permitted to operate the in-home sensor 11, vehicle-mounted sensor 21, and/or the vehicle-mounted device 22 by way of the gateway module 18.

On the other hand, if it is determined that the access authority is absent (case at Step ST43, "NO"), the gateway module 18 rejects the communication from the request transmitter (Step ST45). On this occasion, the request may be ignored, or the request transmitter may be notified of the effect of the request rejection.

Meanwhile, irrespective of presence/absence of an abnormality, there is a case where someone wants to operate each sensor 11, 12 and/or each vehicle-mounted device 22 for situation confirmations and/or the like. For that reason, it is desirable that the sensors 11, 21 and vehicle-mounted devices 22 within the system be made operable even at the normal time. However, if anyone can make an access operation, there arises a problem in security such as a takeover of the system. Thus, there is provided the in-home-system access authority database 19 registering access operation propriety authorities in the system; by managing and referring to the access authority information, an access to each sensor 11, 21 and each vehicle-mounted device 22 by someone other then the registrants is permitted or blocked.

Figure 8:
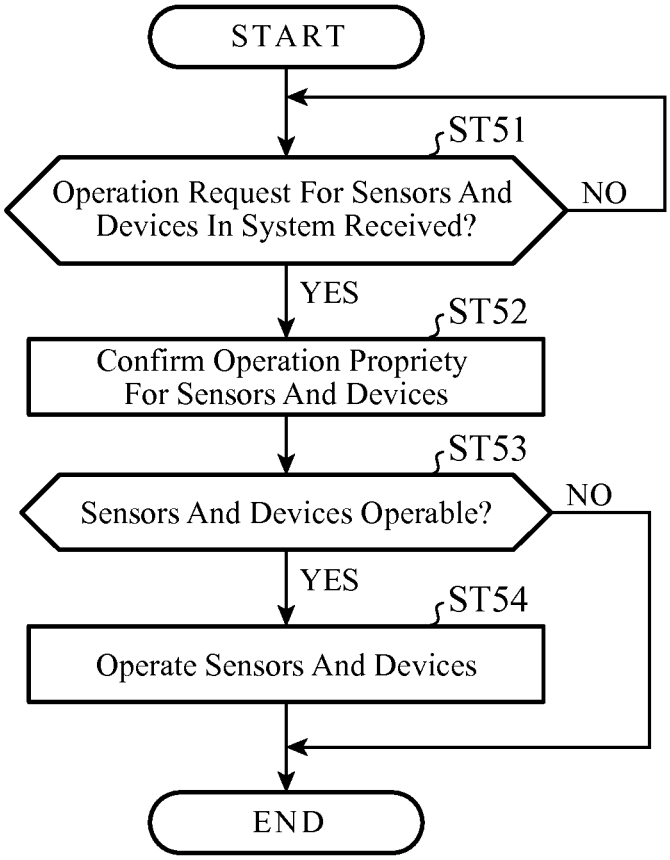
FIG. 8 is a flowchart showing confirmation processing of access operation propriety authority of the home security system according to Embodiment 2.

FIG. 8 is a flowchart showing confirmation processing of an access operation authority propriety of the home security system according to Embodiment 2.

First, when a operation request for the sensors 11, 21 and the vehicle-mounted sensor 22 within the system is transmitted from the external terminal to the in-home system manager 13 through the vehicle-mounted communication module 26, the in-home system manager 13 receives the request after confirmation of the access operation propriety authority to the system in the gateway module 18 (processing shown by the flowchart of FIG. 7). In such a way, when the in-home system manager 13 receives the operation request for the sensors 11, 21 and vehicle-mounted device 22 within the system (case of "YES" at Step ST51), if the operation request is directed to the vehicle-mounted sensor 11, the operation propriety information for the corresponding sensor is acquired from the in-home-system access authority database 19 to be confirmed. In contrast, if the operation request is directed to the vehicle-mounted sensor 21 or vehicle-mounted device 22, the operation propriety information for the corresponding sensor or the vehicle-mounted device is acquired from the mounted device database 28 in the vehicle-mounted system to be confirmed (Step ST52).

Then, when the in-home system manager 13 determines that the sensor or the vehicle-mounted device corresponding to the operation request is operable (case of "YES" at Step ST53) the in-home system manager 13 operates the corresponding sensor 11, 12 or vehicle-mounted device 22 (Step ST54).

As described above, according to Embodiment 2, because there is provided with the gateway module, the access restriction to the system is possible not only at the time of abnormality occurrence but also at the normal time to thereby achieve privacy protection.

Furthermore, when it is configured to be not only browsable but also operable from the outside, it becomes possible to know the situation more broadly to thereby help to be able to grasp more exactly what happens at that place.

On this occasion, there are provided with not only the gateway module but also the access authority DB, which also exhibits more advantageous effects for security and personal information protection.

Embodiment 3

Figure 9:
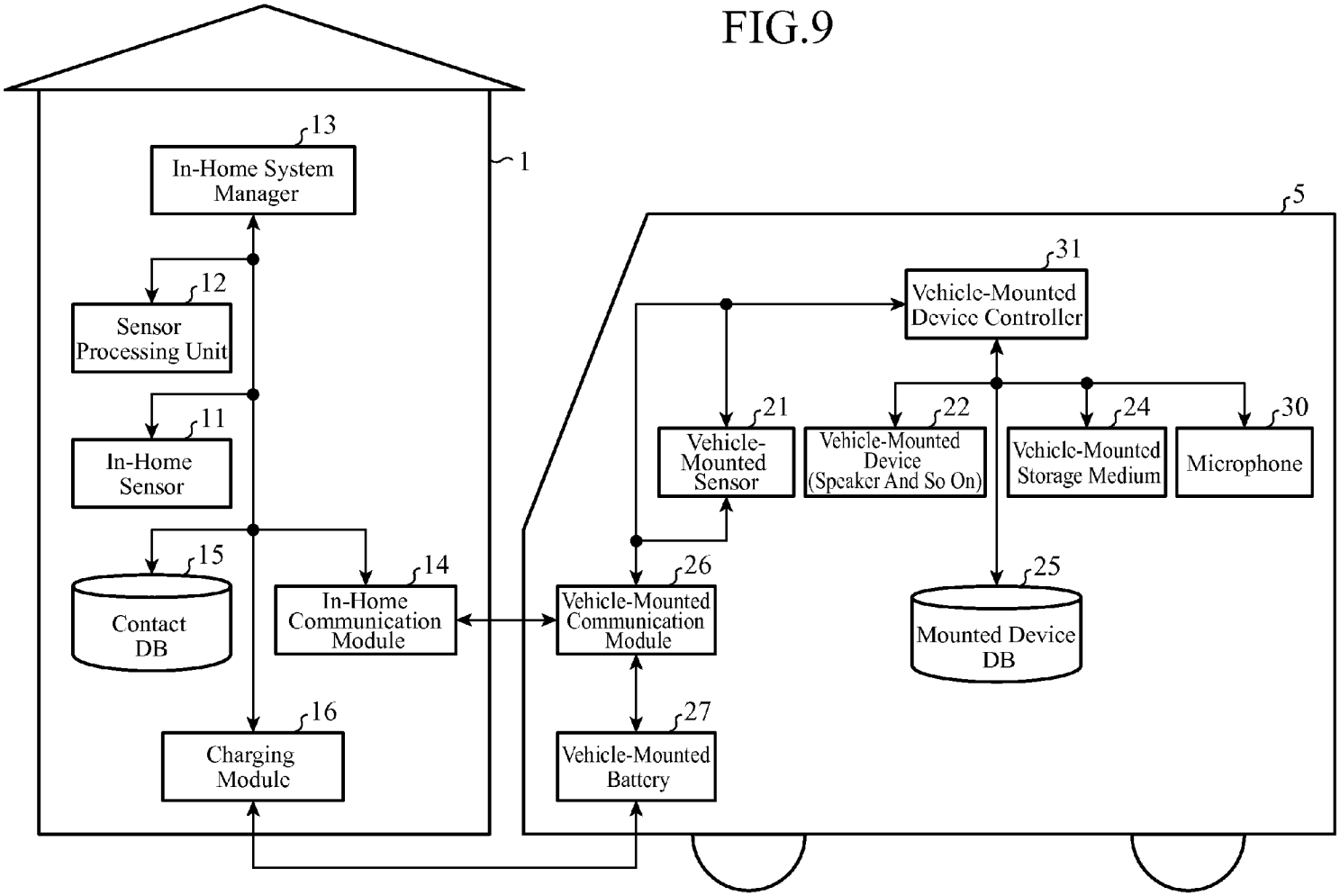
FIG. 9 is a block diagram showing a configuration of a home security system according to Embodiment 3.

FIG. 9 is a block diagram showing a configuration of a home security system according to Embodiment 3. The home security system is configured with an in-home system 1 and a vehicle-mounted system 5 and is the home security system using the vehicle-mounted system 5. Note that the same reference numerals are given for components similar to those described in Embodiments 1 and 2, and duplicated descriptions thereof will be omitted.

The in-home system 1 in Embodiment 3 described below has the same configuration as that of the in-home system 1 shown in Embodiment 1 In comparison with the vehicle-mounted system 2 shown in Embodiment 1, the vehicle-mounted system 5 in Embodiment 3 further includes a microphone 30, and the vehicle-mounted device controller 31 includes, in addition to the function of the vehicle-mounted device controller 23 in Embodiment 1, functions as an encoder for encoding electric signals from the microphone 30 and a decoder for decoding voice data in order for a speaker (vehicle-mounted device 22) to output its sound.

With such a configuration, when a person is present around the vehicle, it becomes possible to interact with the person around the vehicle from an external terminal when an abnormality is sensed. For example, even if a camera image is browsable by accessing from the external terminal, since a blind spot necessarily exists, there may occur a situation where what one wants to see cannot be seen. Further, in addition to this, it is considered that there is also information that cannot be acquired by sensor information alone. Thus, when the microphone is added thereto in this way, and a function that interacts with the person around the vehicle is added thereto, it is possible to acquire even information that cannot be acquired by the sensor information alone.

Figure 10:
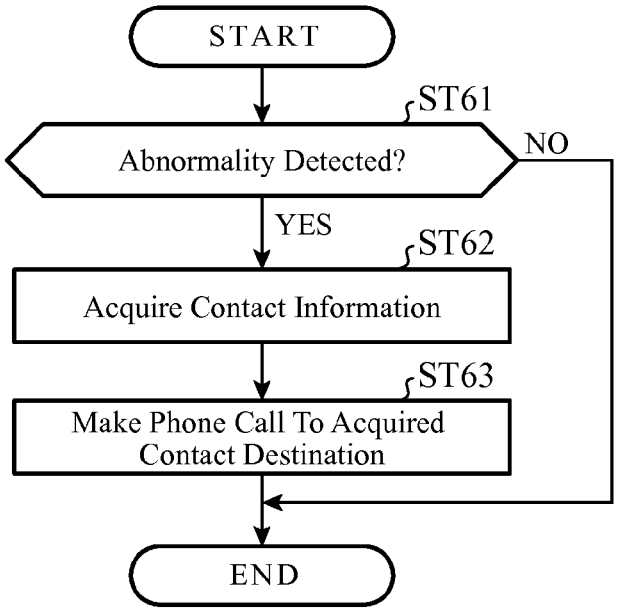
FIG. 10 is a flowchart showing activation processing of a voice interaction function of the home security system according to Embodiment 3.

FIG. 10 is a flowchart showing processing by the home security system according to Embodiment 3 from a sensing of an abnormality to an activation of a voice interaction function.

When the in-home system manager 13 senses an abnormality as a result of acquiring and processing sensor information from an in-home sensor 11 (case of "YES" at Step ST61), the in-home system manager 13 acquires information of contact destinations (registrants and registered facilities registered in advance) to be notified of the abnormality by referring to the contact database (Step ST62). The in-home system manager 13 issues to the vehicle-mounted device controller 31 an instruction to cause it to notify the acquired contact destinations of the effect of abnormality occurrence. Then, in order to notify the notified contact destinations of the effect of abnormality occurrence, the vehicle-mounted device controller 31 having received the instruction makes a phone call to each external terminal of the contact destinations through the vehicle-mounted communication module 26 (Step ST63).

Figure 11:
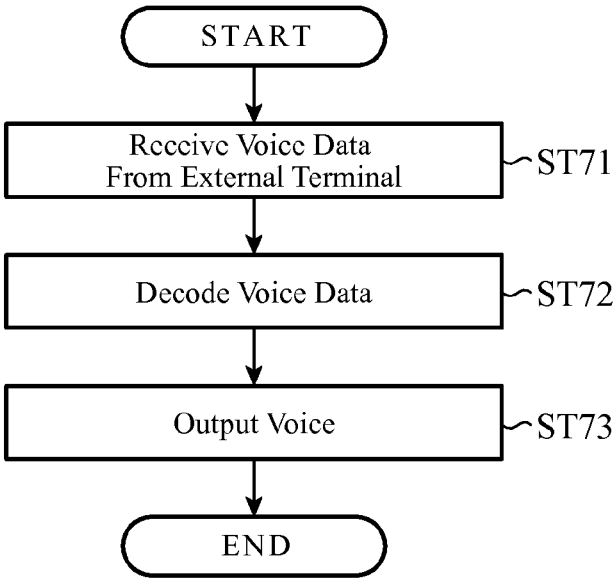
FIG. 11 is a flowchart showing voice data reception and output processes of the home security system according to Embodiment 3.

FIG. 11 is a flowchart showing voice data reception and output processing of the home security system according to Embodiment 3.

When the system becomes in a state to be able to interact with the user at the external terminal as a result of making a phone call to the external terminal at Step ST63 of FIG. 10, the vehicle-mounted device controller 31 receives voice data transmitted from the external terminal through the vehicle-mounted communication module 26 (Step ST71). The vehicle-mounted device controller 31 decodes using its own decoder the received voice data (Step ST72) and outputs the decoded data to the speaker (vehicle-mounted device 22) capable of a vehicle outside output to thus output a voice (Step ST73).

Figure 12:
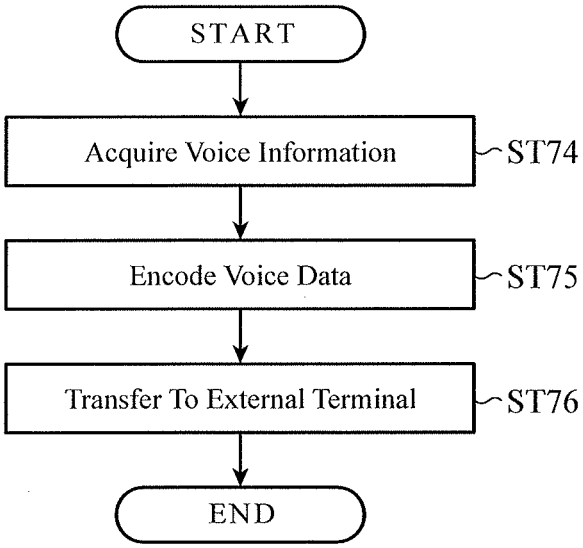
FIG. 12 is a flowchart showing voice data transmission processing of the home security system according to Embodiment 3.

Meanwhile, FIG. 12 is a flowchart showing voice data transmission processing of the home security system according to Embodiment 3.

When the system becomes in a state to be able to interact with the user at the external terminal as a result of making a phone call to the external terminal at Step ST63 of FIG. 10, if a person is present around the vehicle, voice information by the person around the vehicle is acquired by the microphone 30 (Step ST74). The vehicle-mounted device controller 31 encodes using its own encoder the acquired voice data (Step ST75), and transfers (transmits) the encoded data to the external terminal through the vehicle-mounted communication module 26 (Step ST76).

As described above, according to Embodiment 3, since it is configured such that the person around the vehicle and the user at the external terminal can interact with each other through the microphone, it is possible to help collect more detailed information that cannot be found by the user at the external terminal from the sensor information alone.

Embodiment 4

Figure 13:
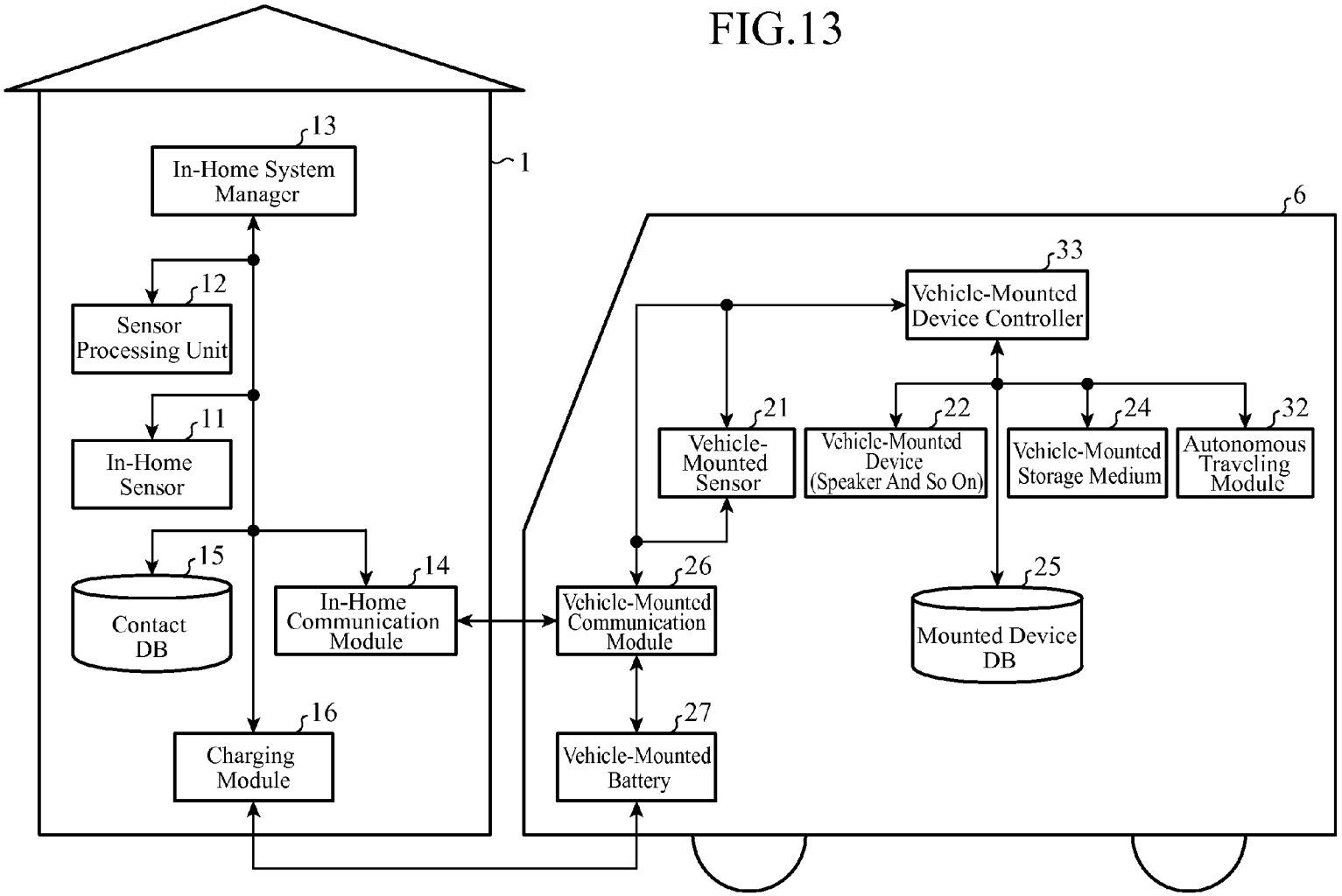
FIG. 13 is a block diagram showing a configuration of a home security system according to Embodiment 4.

FIG. 13 is a block diagram showing a configuration of a home security system according to Embodiment 4. The home security system is configured with an in-home system 1 and a vehicle-mounted system 6, and is the home security system using the vehicle-mounted system 6. Note that the same reference numerals are given for components similar to those described in Embodiments 1 to 3, and duplicated descriptions thereof will be omitted.

The in-home system 1 in Embodiment 4 described below has the same configuration as that of the in-home system 1 shown in Embodiment 1. On the other hand, in comparison with the vehicle-mounted system 2 shown in Embodiment 1, the vehicle-mounted system 6 in Embodiment 4 further includes an autonomous traveling module 32, and a vehicle-mounted device controller 33 includes a function to issue an activation instruction to the autonomous traveling module 32 in addition to the function of the vehicle-mounted device controller 23 in Embodiment 1.

This is the function added thereto in view of the following situation: in a case where one's home-site area is large, a case where a parking area thereof is located in its inner part, and/or the like, when an abnormality is sensed, even if a vehicle-mounted device 22 such as a speaker capable of a vehicle outside output notifies a message of the surroundings, the message cannot reach the neighborhood. Namely, the following is contemplated: a vehicle moves from the parking area to a place near neighboring homes such that the surroundings can be notified of the message as much as possible, so that more people can be informed of the message.

Figure 14:
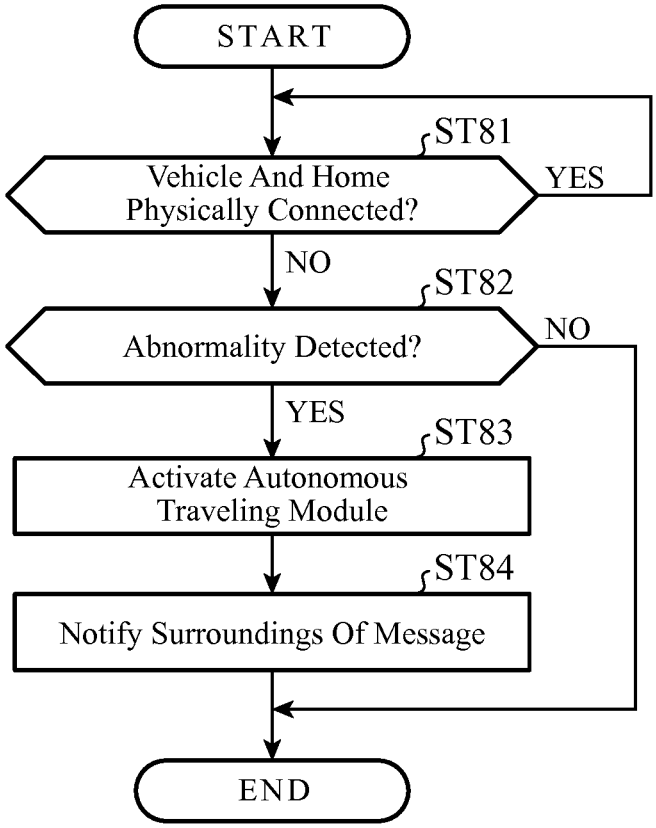
FIG. 14 is a flowchart showing activation processing of an autonomous traveling module of the home security system according to Embodiment 4.

FIG. 14 is a flowchart showing activation processing of the autonomous traveling module of the home security system according to Embodiment 4.

First, when the vehicle and the home is physically connected to each other by a cable during charging, for example (case of "YES" at Step ST81), it is dangerous to activate the autonomous traveling module 32; thus, confirmation for this is made at first, and the autonomous traveling module 32 is not activated if they are physically connected.

On the other hand, when the vehicle and the home is not physically connected to each other (case of "NO" at Step ST81), and if the system senses an abnormality (case of "YES" at Step ST82), the vehicle-mounted device controller 33 gives an instruction to the autonomous traveling module 32 for activating it (Step ST83).

The autonomous traveling module 32 recognizes obstacles by using information from the vehicle-mounted sensor 21 to thereby notify the vehicle-mounted device controller 33 of how the vehicle-mounted device 22 related to an travel should be operated. Then, the vehicle-mounted device controller 33 operates the vehicle-mounted device 22 on the basis of the notified result. In this manner, the vehicle can move to a place near the neighboring homes within the one's home site.

Thereafter, the surroundings are notified of a message from the vehicle-mounted device 22 such as a speaker capable of a vehicle outside output (Step ST84). In this manner, the message can be surely outputted to the neighborhood at an abnormality sensing to thereby inform more people of the message; thus, it is possible to call for help and/or call attention to the surroundings more efficiently.

As described above, according to Embodiment 4, because there is provided with the autonomous traveling module, it is possible to transmit information more broadly even in a case where it is less effective to inform the surroundings of the abnormality-related information, for example, in the case where the one's home-site area is broad, the case where the parking area is located in its inner part, and/or the like.

Embodiment 5

Figure 15:
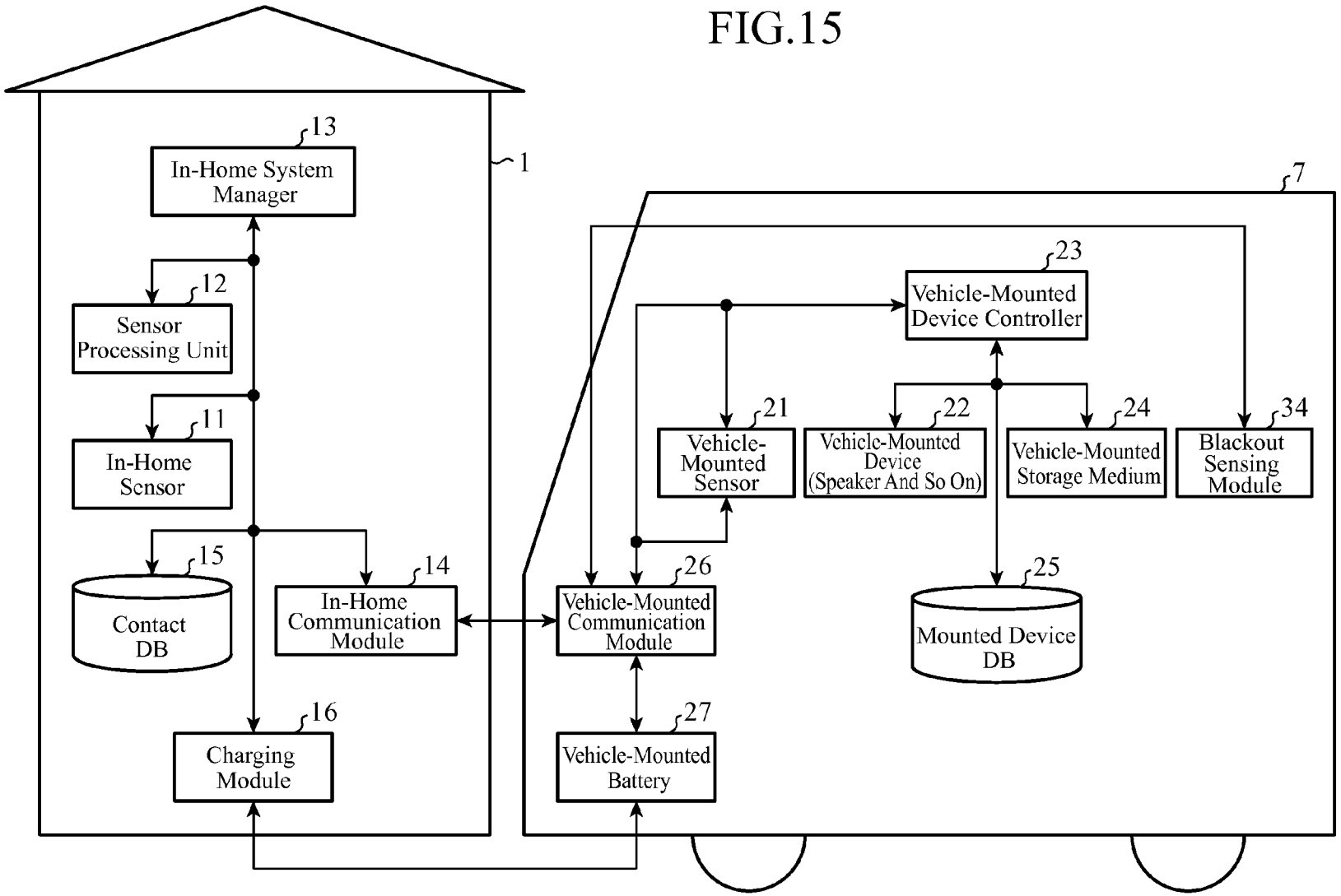
FIG. 15 is a block diagram showing a configuration of a home security system according to Embodiment 5.

FIG. 15 is a block diagram showing a configuration of a home security system according to Embodiment 5. The home security system is configured with an in-home system 1 and a vehicle-mounted system 7, and is the home security system using the vehicle-mounted system 7. Note that the same reference numerals are given for components similar to those described in Embodiments 1 to 4, and duplicated descriptions thereof will be omitted.

The in-home system 1 in Embodiment 5 described below has the same configuration as that of the in-home system 1 shown in Embodiment 1. On the other hand, in comparison with the vehicle-mounted system 2 shown in Embodiment 1, the vehicle-mounted system 7 in Embodiment 5 further includes a blackout sensing module 34.

The blackout sensing module 34 is the module for sensing whether a blackout occurs or not in the home, and confirms whether or not the blackout occurs when the communication between the in-home system manager 13 and the vehicle-mounted device controller 23 is suddenly disconnected.

In an event that the power blackout occurs, since the security system in the home is down to be inoperable, it becomes unable to detect abnormalities such as an intrusion of a suspicious person and a fire. Thus, in Embodiment 5, the following is contemplated: whether or not the blackout occurs is confirmed, and when the occurrence of the blackout is affirmative, charging is performed from the vehicle-mounted battery 27 to the home, thereby supplying power required to operate the security system in the home.

Figure 16:
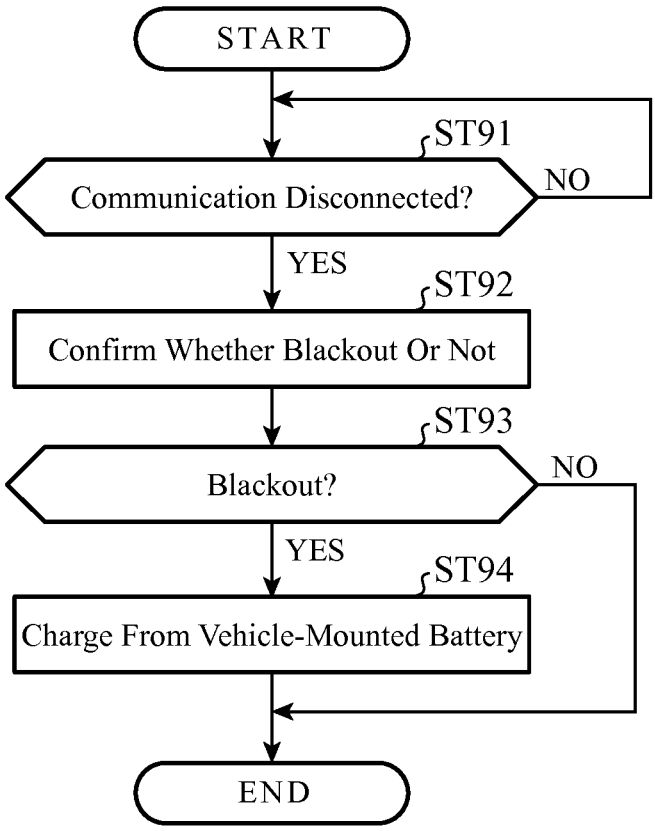
FIG. 16 is a flowchart, showing blackout confirmation processing of the home security system according to Embodiment 5.

FIG. 16 is a flowchart showing blackout confirmation processing of the home security system according to Embodiment 5 of the invention.

Communication is established between the in-home system manager 13 and the vehicle-mounted device controller 23; during operation of the home security system, if the communication is suddenly disconnected (case of "YES" at Step ST91), the blackout sensing module 34 confirms whether or not a reason for the communication disconnection is due to the occurrence of a blackout (Step ST92).

As a confirmation method of whether or not a blackout occurs, various ones are considered; for example, it is confirmed such that the vehicle makes communication with nearby vehicles and inquires charged situations of the vehicles. If possible, communication situations between the nearby vehicles and these respective in-home systems are inquired. On this occasion, if a given number or more of the nearby vehicles respond that the charging thereto or the communication with the in-home system is suddenly stopped or disconnected, it is determined that a blackout has occurred in that region.

Further, as another confirmation method, for example, communication is performed with a server of an electric power company to inquire blackout information in the neighborhood. In the case of a planned blackout or a blackout due to a construction or the like, the electric power company must have information thereof. As a result, when a response such that a blackout is implemented around the home is acquired, it is determined that the reason for the communication disconnection is the blackout.

Then, when the disconnection is determined as "blackout" (case of "YES" at Step ST93), power required to operate the in-home system is supplied from the vehicle-mounted battery 27 (Step ST94). In contrast, when it is determined as "not blackout" (case of "NO" at Step ST94), since it is considered that a breaker tripped intentionally or due to excessive use of electricity or the like, the processing is ended without charging.

When the blackout occurs (case of "YES" at Step ST93), the security system in the home will stop its operation unless including an emergency battery (sub battery). As a result, even if an abnormal situation occurs by an intrusion of a suspicious person, a fire, or the like, it becomes unable to sense such an abnormality as well as to deal with the abnormality.

Thus, in Embodiment 5, the blackout sensing module 34 is added thereto as a component of the system in order to bring a sub-battery function into the system. When the blackout sensing module 34 senses a blackout, the system supplies power required to keep the operation of the security system from the vehicle-mounted battery 27 to the in-home system 1 through the charging module 16. Because of this function, it becomes possible to prevent the security from being degraded during blackout.

As described above, according to Embodiment 5, there is provided with the blackout sensing module; since it is configured such that when a blackout is sensed, power required to operate the in-home security system from the vehicle-mounted battery is supplied, it is possible to maintain the security in the home such that a stop of the in-home security system is prevented during blackout even when there is no emergency battery in the home.

Embodiment 6

Figure 17:
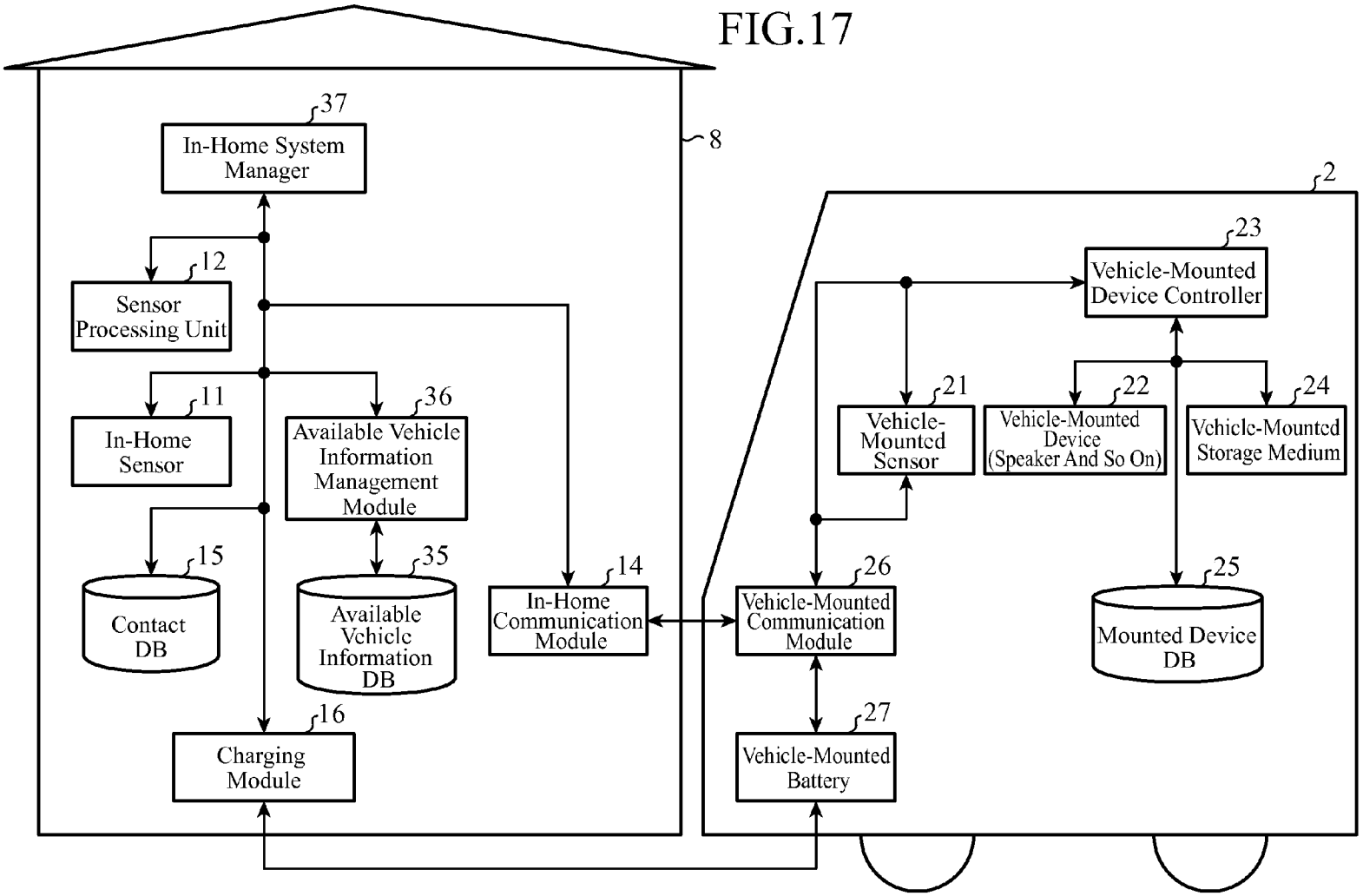
FIG. 17 is a block diagram showing a configuration of a home security system according to Embodiment 6.

FIG. 17 is a block diagram showing a configuration of a home security system according to Embodiment 6. The home security system is configured with an in-home system 8 and a vehicle-mounted system 2, and is the home security system using the vehicle-mounted system 2. Note that the same reference numerals are given for components similar to those described in Embodiments 1 to 5, and duplicated descriptions thereof will be omitted.

In comparison with the in-home system 1 shown in Embodiment 1, the in-home system 8 in Embodiment 6 described below further includes an available vehicle information management database (available vehicle information management DB) 35, and an available vehicle information management module 36, and the in-home system manager 37 includes, in addition to the function of the in-home system manager 13 in Embodiment 1, a function to give an instruction to the available vehicle information management module 36 and receives information therefrom. Meanwhile, the vehicle-mounted system 2 in Embodiment 6 has the same configuration as that of the vehicle-mounted system 2 shown in Embodiment 1.

Information of nearby vehicles that are available at the time of abnormality occurrence is registered in advance in the available vehicle information management database 35, and stores a list of the vehicles information.

The available vehicle information management module 36 serves to register the information of the nearby vehicles that are available at the time of abnormality occurrence into the available vehicle information management database 35, or to refer to/confirm the database 35 at the time of abnormality sensing.

This is because in some cases, it is useful for the security to operate not only the vehicle in which communication with the home is established, but also a nearby vehicle. For example, in a case where a suspicious person is sensed, acquisition of a camera image for the nearby vehicle makes it possible to trace the movement of the suspicious person. Further, for example, in a case where the occurrence of a fire is sensed, it becomes possible to inform more people of the neighborhood of the effect of the occurrence of the fire in the vicinity. However, since it is legally a problem to use other people's vehicles without permission; thus, information of the available nearby vehicles have been registered in advance and retained with consent of the owners of the nearby vehicles, and when an abnormality is sensed, the vehicle to be used is selected on the basis of the information.

Figure 18:
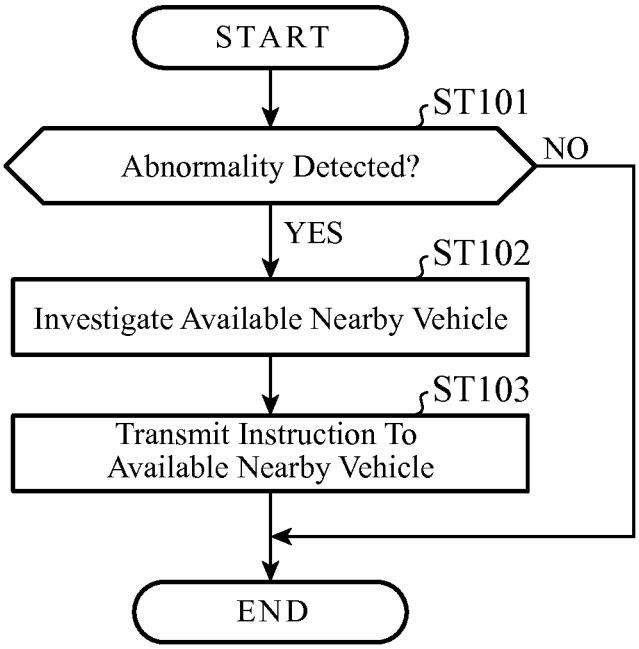
FIG. 18 is a flowchart showing operation processing of a emergency nearby vehicle utilization function of the home security system according to Embodiment 6.

FIG. 18 is a flowchart showing an operation process about a emergency nearby vehicle utilization function of the home security system according to Embodiment 6.

When the in-home system manager 37 senses an abnormality as a result of acquiring and processing the sensor information from the in-home sensor 11 (case of "YES" at Step ST101), the in-home system manager 37 notifies the available vehicle information management module 36 of an instruction for investigating available nearby vehicles (Step ST102). When receiving the instruction, the available vehicle information management module 36 extracts information of the available nearby vehicles from the available vehicle information management database 35, and returns the result to the in-home system manager 37.

When receiving the result, the in-home system manager 37 notifies the vehicle-mounted device mounted on the available nearby vehicles of an abnormality processing request to deal with the abnormality (Step ST103). However, since each vehicle has each different equipment, an abstract instruction such as "Be notified of the effect of the occurrence of a fire" is transmitted thereto at the time of the occurrence of a fire, for example, and an execution method therefor is left to each vehicle.

As described above, according to Embodiment 6, by using not only the vehicle-mounted system of the vehicle in which the communication with the home is established, but also the vehicle-mounted sensor and/or the vehicle-mounted device of a nearby vehicle, the following effective countermeasures can be implemented at the time of abnormality occurrence: the movement of a suspicious person can be traced, more people can be informed of the effect of the occurrence of a fire, and so on.

Embodiment 7

Figure 19:
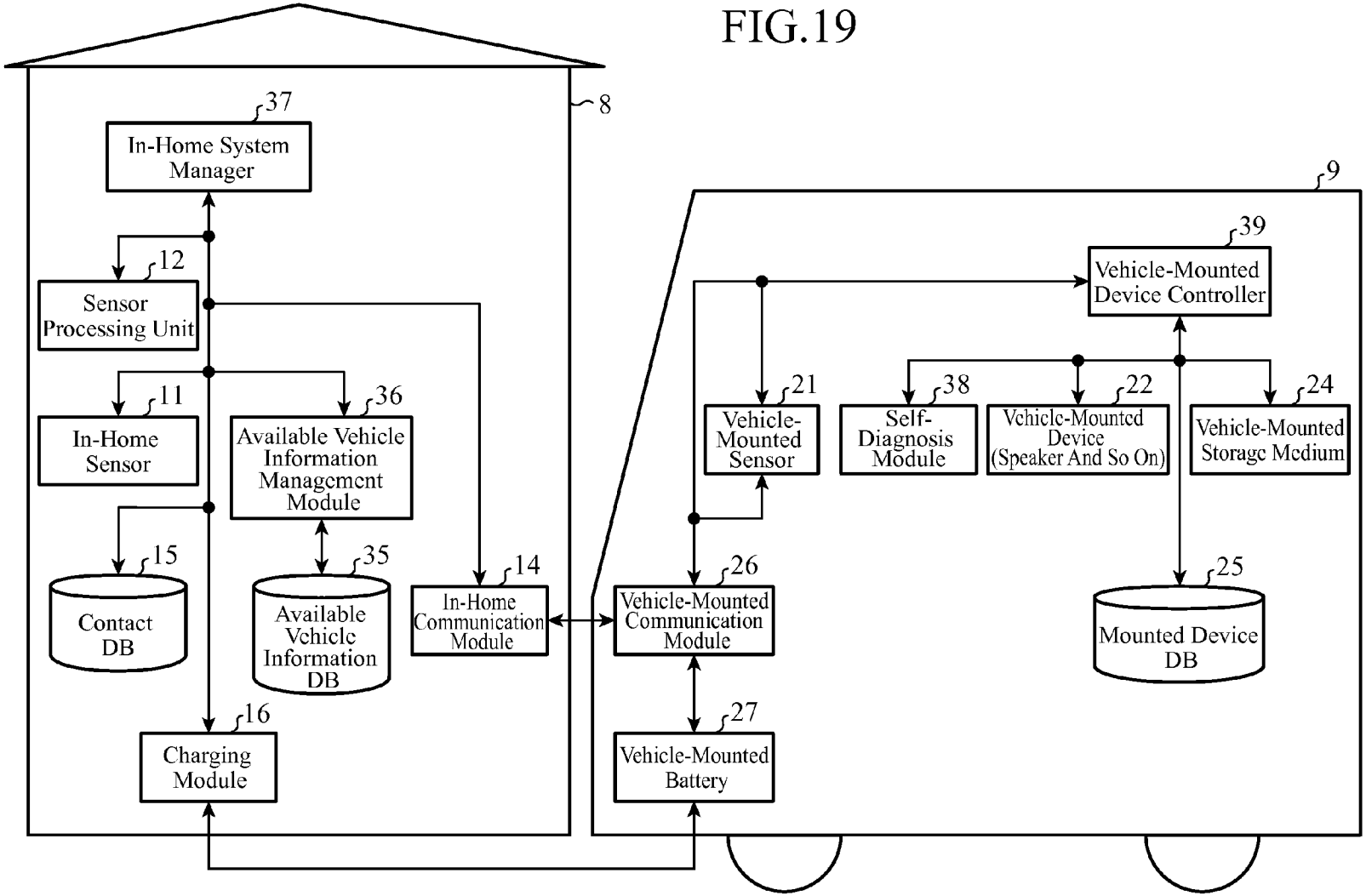
FIG. 19 is a block diagram showing a configuration of a home security system according to Embodiment 7.

FIG. 19 is a block diagram showing a configuration of a home security system according to Embodiment 7. The home security system is configured with an in-home system 8 and a vehicle-mounted system 9 and thus is a home security system using the vehicle-mounted system 9. Note that the same reference numerals are given for components similar to those described in Embodiments 1 to 6, and duplicated descriptions thereof will be omitted.

The in-home system 8 in Embodiment 7 described below has the same configuration as that of the in-home system 8 shown in Embodiment 6. On the other hand, in comparison with the vehicle-mounted system 2 in Embodiment 1 or 6, a vehicle-mounted system 9 in Embodiment 7 further includes a self-diagnosis module 38, and a vehicle-mounted device controller 39 includes, in addition to the function of the vehicle-mounted device controller 23 in Embodiment 1 or 6, a function of notifying the in-home system manager 37 of the failed sensor or vehicle-mounted device when the self-diagnosis module 33 finds a failure.

At the normal time (abnormality non-sensing time), the self diagnosis module 38 determines whether each vehicle-mounted sensor 21 or vehicle-mounted device 22 is failed or not. A determination method is carried out by, for example, comparing an output result with respect to an input with a sample value. However, since a confirmation method is different for each of the sensors and devices, a test matching the vehicle-mounted sensor 21 or vehicle-mounted device 22 is performed to thus confirm presence/absence of the failure.

This is because that if a failure of the sensor or device is found only at the time when a countermeasure should be taken at an abnormality sensing time, and then if a substitute nearby vehicle is searched, a time loss arises due to the search. This time loss is problematic because a moment to lose is not permitted in an emergency situation.

Thus, the vehicle-mounted system 9 is configured to include the self-diagnosis module 38, and presence/absence of a failure of the vehicle-mounted sensor 21 and vehicle-mounted device 22 is confirmed at fixed intervals by the self-diagnosis module 38. Then, when a failure is found, an alarm is output to the owner of the vehicle; at the same time, by making a guess at which vehicle is to be used at the abnormality sensing, it is possible to eliminate the time loss due to the search of the substitute nearby vehicle.

Figure 20:
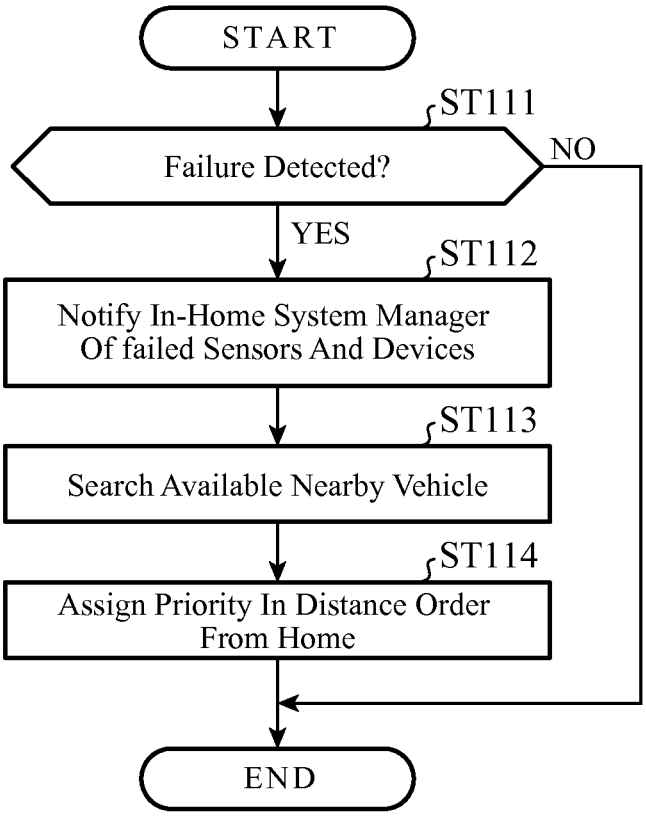
FIG. 20 is a flowchart showing substitute vehicle search processing in failure finding of the home security system according to Embodiment 7.

FIG. 20 is a flowchart showing substitute vehicle retrieval processing at the time when a failure is found of the home security system according to Embodiment 7.

The self-diagnosis module 38 constantly confirms at fixed intervals presence/absence of a failure for every vehicle-mounted sensor 21 and vehicle-mounted device 22 using a method matching the sensor or device. Then, when the self-diagnosis module 38 finds a failure of the vehicle-mounted sensor 21 or the vehicle-mounted device 22 (Step ST111), the vehicle-mounted device controller 39 receives a notification of the failure finding, notifies the in-home system manager 37 of which vehicle-mounted sensor 21 or vehicle-mounted device 22 is failed (Step ST112).

The in-home system manager 37 receives the notification of the failure finding, and notifies the available vehicle information management module 36 to search available nearby vehicles (Step ST113). When receiving it, the available vehicle information management module 36 extracts information of the available nearby vehicles from the available vehicle information management database 35, sorts the extracted information, for example, in distance order from the home, and retains the sorted result (Step ST114). After that, when the in-home system manager 37 makes a request for the information of the available nearby vehicles at an abnormality sensing time, to the available vehicle information management module 36 (case where a search instruction is given at Step ST102 in the flowchart shown in FIG. 18), the management module returns the result retained with the assigned order of priority at Step ST114. Then, at the abnormality sensing, the vehicle-mounted systems mounted in the nearby vehicles are instructed to deal with the abnormality on the basis of the result retained with the assigned order of priority.

Note that how to assign the order of priority may be based on another index or parameter, for example, registration order registered in the available vehicle information management database 35, other than the distance order from the home as mentioned above.

As described above, according to Embodiment 7, it is configured such that from the failure detection by the self-diagnosis module, the substitute vehicles are searched in advance and retained with the assigned order of priority; thus, when the vehicle-mounted sensor or the vehicle-mounted device is out of order at the abnormality sensing time, it is possible to eliminate the time loss due to the search of the substitute nearby vehicle, thereby promptly dealing with the abnormality using the nearby vehicle.

It is noted that the present invention can be implemented by a free combination of the embodiments, a modification of arbitrary components of the embodiments, or an omission of arbitrary components of the embodiments, within the scope of the invention.

INDUSTRIAL APPLICABILITY

As described above, according to the some security system and the vehicle-mounted system used in the same according to the present invention, even if the vehicle and the home are not physically connected to each other, the vehicle-mounted system can be effectively used, and can be used as a home security system that is highly effective to prevent a crime.

DESCRIPTION OF REFERENCE NUMERALS AND SIGNS

1, 3, 8: in-home system, 2, 4, 5, 6, 7, 9: vehicle-mounted system, 11: in-home sensor, 12: sensor processing unit, 13, 37: in-home system manager, 14: in-home communication module, 15: contact database (contact destination DB), 16: charging module, 17: contact database (contact destination DB), or access destination database, 18: gateway module, 19: in-home-system access authority database (in-home-system access authority DB), or in-home-system operation authority database, 21: vehicle-mounted sensor, 22: vehicle-mounted device, 23, 29, 31, 33, 39: vehicle-mounted device controller, 24: vehicle-mounted storage medium, 25: mounted device database (mounted device DB), 26: vehicle-mounted communication module, 27: vehicle-mounted battery, 28: mounted device database (mounted device DB), or mounted-device and vehicle-mounted-system-operation-authority database, 30: microphone, 32: autonomous traveling module, 34: blackout sensing module, 35: available vehicle information database (available vehicle information DB), 36: available vehicle information management module, 38: self-diagnosis module.

The invention claimed is:

1. A home security system that comprises an in-home system that communicates with a vehicle-mounted system, the in-home system comprising:

an in-home sensor that is installed in a home and is capable of detecting a state of the home;

an in-home system manager configured to sense an abnormality in the state of the home from information of the in-home sensor, and decide to instruct a vehicle-mounted device to deal with the abnormality; and an in-home communication module that is capable of communicating with a vehicle-mounted communication module in the vehicle-mounted system, wherein the vehicle-mounted device is mounted on a vehicle and is capable of providing an output outside the vehicle, and the vehicle-mounted communication module is capable of communicating with the in-home system via the in-home communication module, wherein when the in-home system manager senses the abnormality, the in-home communication module transmits the instruction from the in-home system to the vehicle-mounted communication module thus prompting the vehicle-mounted device to deal with the abnormality according to the instruction, the vehicle-mounted system further comprising a vehicle-mounted sensor that is mounted on the vehicle and is capable of detecting a state around or inside the vehicle, and wherein the in-home system manager manages access to the information of the in-home sensor and information of the vehicle-mounted sensor by an external terminal such that, when the abnormality is sensed, the in-home system permits the information of the in-home sensor and the information of the vehicle-mounted sensor to be browsed from the external terminal, and wherein the in-home system confirms which type of the vehicle-mounted device is mounted on the vehicle when the communication between the in-home system and the vehicle-mounted system is established by the in-home communication module and the vehicle-mounted communication module.

2. The home security system according to claim 1, wherein when the in-home system manager senses the abnormality, the in-home system instructs the vehicle-mounted system to output a message to surroundings of the vehicle using a speaker that is the vehicle-mounted device.

3. The home security system according to claim 1, wherein in a case where the in-home system manager senses the abnormality, if the abnormality is determined to be due to a suspicious person, the in-home system instructs the vehicle-mounted system to perform an output to threaten the suspicious person using the vehicle-mounted device.

4. The home security system according to claim 1, wherein the in-home system further comprises a contact database in which a registrant or a registered facility to be notified of the abnormality is registered in advance when the abnormality occurs, wherein when the abnormality is sensed, the system notifies the registrant or registered facility registered in advance in the contact database of the effect that the abnormality is sensed via the in-home communication module and the vehicle-mounted communication module.

5. The home security system according to claim 1, wherein the in-home system further comprises an access destination database in which a registrant or a registered facility capable of accessing the home security system from the external terminal is registered in advance, and a gateway module that performs access restriction on the basis of the access destination database, and wherein in an access from the external terminal, the access is done through the vehicle-mounted communication module and the gateway module.

6. The home security system according to claim 5, wherein when the abnormality is sensed, the in-home system permits the in-home sensor, the vehicle-mounted sensor and the vehicle-mounted device to be operated from the external terminal of the registrant or the registered facility registered in advance in the access destination database through the gateway module.

7. The home security system according to claim 4, wherein the vehicle-mounted system further comprises a microphone, and wherein when the abnormality is sensed, the in-home system makes a phone call to an external terminal of the registrant or the registered facility registered in advance in the contact database.

8. The home security system according to claim 1, wherein the in-home system further comprises a charging module, and the vehicle-mounted system further comprises a vehicle-mounted battery and a blackout sensing module, and wherein power required to activate the in-home system is supplied from the vehicle-mounted battery to the charging module when the blackout sensing module senses a blackout in the in-home system.

9. A home security system that comprises an in-home system and a vehicle-mounted system, the in-home system comprising an in-home sensor that is installed in a home and is capable of detecting a state of the home, and an in-home communication module that is capable of communicating with the vehicle-mounted system to sense an abnormality from information of the in-home sensor, and the vehicle-mounted system comprising a vehicle-mounted device that is mounted on a vehicle and is capable of a vehicle outside output, and a vehicle-mounted communication module that is capable of communicating with the in-home system via the in-home communication module, wherein when the in-home system senses the abnormality, an instruction is received from the in-home system via the in-home communication module and vehicle-mounted communication module to deal with the abnormality using the vehicle-mounted device according to the instruction, the vehicle-mounted system further comprising a vehicle-mounted sensor that is mounted on the vehicle and is capable of detecting a state around or inside the vehicle, and wherein when the abnormality is sensed, the in-home system permits the information of the in-home sensor and the vehicle-mounted sensor to be browsed from an external terminal, wherein the in-home system further comprises an available vehicle information database in which available nearby vehicles are registered in advance when the abnormality occurs, along with information indicative of an order of priority of said available nearby vehicles, and wherein when the abnormality is sensed, a vehicle-mounted system mounted on the nearby vehicle registered in advance in the available vehicle information database is instructed to deal with the abnormality.

10. The home security system according to claim 9, wherein the vehicle-mounted system further comprises a vehicle-mounted storage medium, and wherein the information from the in-home sensor is constantly stored in the vehicle-mounted storage medium when the communication between the in-home system and the vehicle-mounted system is established by the in-home communication module and the vehicle-mounted communication module.

11. The home security system according to claim 9, wherein the vehicle-mounted system further comprises a vehicle-mounted-system operation authority database that also holds operation propriety information from the external terminal to the vehicle-mounted system, in the registrant or the registered facility capable of accessing the home security system, wherein the in-home system further comprises an in-home-system operation authority database that also holds operation propriety information from the external terminal to the in-home system, in the registrant or the registered facility registered in advance in the access destination database, and wherein the operation authority from the external to the registrant or the registered facility registered in advance in the access destination database is administered by referring to the in-home-system operation authority database and the vehicle-mounted-system operation authority database.

12. The home security system according to claim 9, wherein the vehicle-mounted system further comprises an autonomous traveling module, and outputs a message to surroundings of the vehicle using the vehicle-mounted device of the vehicle-mounted system while activating the autonomous traveling module, when the in-home system senses the abnormality.

13. The home security system according to claim 9, wherein the vehicle-mounted system further comprises a self-diagnosis module that finds a failure of the vehicle-mounted sensor and the vehicle-mounted device, and wherein the in-home system searches the nearby vehicle that is available as a substitute for the failed vehicle-mounted sensor or vehicle-mounted device from the available vehicle information database, and holds the resultant with an assigned order of priority, and wherein when the abnormality is sensed, the vehicle-mounted system mounted on the nearby vehicle is instructed to deal with the abnormality on the basis of a result held with the assigned order of priority.

14. A vehicle-mounted system that is used by a home security system provided with an in-home system for sensing an abnormality regarding the state of a home based on information from an in-home sensor, the system comprising:

a vehicle-mounted device that is mounted on a vehicle and is capable of a vehicle outside output; and a vehicle-mounted communication module that is capable of communicating with the in-home system, wherein when the in-home system senses the abnormality, an instruction is transmitted from the in-home system to the vehicle-mounted communication module thereby prompting the vehicle-mounted device to deal with the abnormality, the vehicle-mounted system further comprising a vehicle-mounted sensor that is mounted on the vehicle and is capable of detecting a state around or inside the vehicle, and wherein when the abnormality is sensed, the in-home system permits the information of the in-home sensor and information of the vehicle-mounted sensor to be browsed from an external terminal, and wherein, when the communication between the in-home system and the vehicle-mounted system is established by the in-home communication module and the vehicle-mounted communication module, the vehicle-mounted system provides information that is used by the in-home system to confirm which type of the vehicle-mounted device is mounted on the vehicle.

15. The vehicle-mounted system according to claim 14, wherein when the in-home system senses the abnormality, a message is outputted to surroundings of the vehicle using a speaker that is the vehicle-mounted device.

16. The vehicle-mounted system according to claim 14, wherein in a case where the in-home system senses the abnormality, if the abnormality is determined to be due to a suspicious person, an output is performed to threaten the suspicious person using the vehicle-mounted device.

17. The vehicle-mounted system according to claim 14, further comprising an autonomous traveling module, wherein when the in-home system senses the abnormality, a message is outputted to surroundings of the vehicle using a speaker that is the vehicle-mounted device while activating the autonomous traveling module.

18. The vehicle-mounted system according to claim 14, further comprising a charging module and a blackout sensing module, wherein when the blackout sensing module senses a blackout in the in-home system, power required to activate the in-home system is supplied from the vehicle-mounted battery to the in-home system.

* * * * *